US010831122B2

(12) United States Patent
Kuribayashi

(10) Patent No.: US 10,831,122 B2
(45) Date of Patent: Nov. 10, 2020

(54) OPTICAL SCANNING DEVICE AND IMAGE FORMING APPARATUS

(71) Applicant: TOSHIBA TEC KABUSHIKI KAISHA, Tokyo (JP)

(72) Inventor: Yasushi Kuribayashi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/539,885

(22) Filed: Aug. 13, 2019

(65) Prior Publication Data

US 2020/0233332 A1 Jul. 23, 2020

(30) Foreign Application Priority Data

Jan. 22, 2019 (JP) ..... 2019-008500

(51) Int. Cl.
*G03G 15/04* (2006.01)

(52) U.S. Cl.
CPC ..... *G03G 15/04036* (2013.01)

(58) Field of Classification Search
CPC .... G03G 15/04; G03G 15/011; G03G 15/043; G03G 15/0435; G03G 15/04036; G03G 2215/04; G03G 2215/0402; G03G 2215/0407; G03G 2221/1636
See application file for complete search history.

(56) References Cited

U.S. PATENT DOCUMENTS

2011/0002712 A1 1/2011 Kudo
2015/0205097 A1* 7/2015 Kudo ..... G02B 26/123 347/118

FOREIGN PATENT DOCUMENTS

JP 2000-221432 A 8/2000

* cited by examiner

*Primary Examiner* — Thomas S Giampaolo, II
(74) *Attorney, Agent, or Firm* — Foley & Lardner LLP

(57) ABSTRACT

An optical scanning device includes a first light source, a second light source, a first aperture, a second aperture, a third aperture, and a deflector. The first light source emits a first light flux. The second light source emits a second light flux. The second light flux is separated from the first light flux by an opening angle in a main scanning direction. The first aperture shapes a beam shape of the first light flux in a sub-scanning direction. The second aperture shapes a beam shape of the second light flux in the sub-scanning direction. The third aperture shapes the beam shape of the first light flux and the beam shape of the second light flux. The deflector deflects the first light flux and the second light flux at positions separated in the sub-scanning direction on a surface.

18 Claims, 10 Drawing Sheets

OPTICAL SCANNING DEVICE AND IMAGE FORMING APPARATUS

CROSS-REFERENCE TO RELATED APPLICATION

This application is based upon and claims the benefit of priority from Japanese Patent Application No. 2019-008500, filed Jan. 22, 2019, the entire contents of which are incorporated herein by reference.

FIELD

Embodiments described herein relate generally to an optical scanning device and an image forming apparatus.

BACKGROUND

Electrostatic latent images may be formed by an electrophotographic image forming apparatus on an image plane by scanning an image with a beam. Such an electrophotographic image forming apparatus may shape a cross-sectional shape of the beam with an aperture in order to improve quality of an electrostatic latent image. The beam may be composed of a plurality of beams each of which is emitted from a light emitting point having a distance in a main scanning direction. After passing through the aperture, each of the plurality of beams may spread in the main scanning direction, which may result in different light beam passing positions, thereby leading to degradation of the quality of the electrostatic latent image.

DETAILED DESCRIPTION

Embodiments described herein generally provide an optical scanning device and an image forming apparatus capable of improving image quality.

In general, according to one embodiment, an optical scanning device includes a first light source, a second light source, a first aperture, a second aperture, a third aperture, and a deflector. The first light source emits a first light flux (e.g., light beam, etc.). The second light source emits a second light flux having an opening angle with respect to the first light flux, the opening angle measured in a main scanning direction. The first aperture shapes a beam shape of the first light flux in a sub-scanning direction. The second aperture shapes a beam shape of the second light flux in the sub-scanning direction. The third aperture shapes the beam shape of the first light flux passing through the first aperture in the main scanning direction and the beam shape of the second light flux passing through the second aperture in the main scanning direction. The deflector deflects the first light flux and the second light flux which pass through the third aperture at positions separated along the sub-scanning direction on the same surface.

Hereinafter, an image forming apparatus according to an embodiment will be described with reference to the drawings. In each drawing used for description of the following embodiment, the scale of each part may be changed as appropriate. Also, for the sake of explanation, each drawing used for description of the following embodiment may be illustrated with the configuration omitted.

Figure 1:
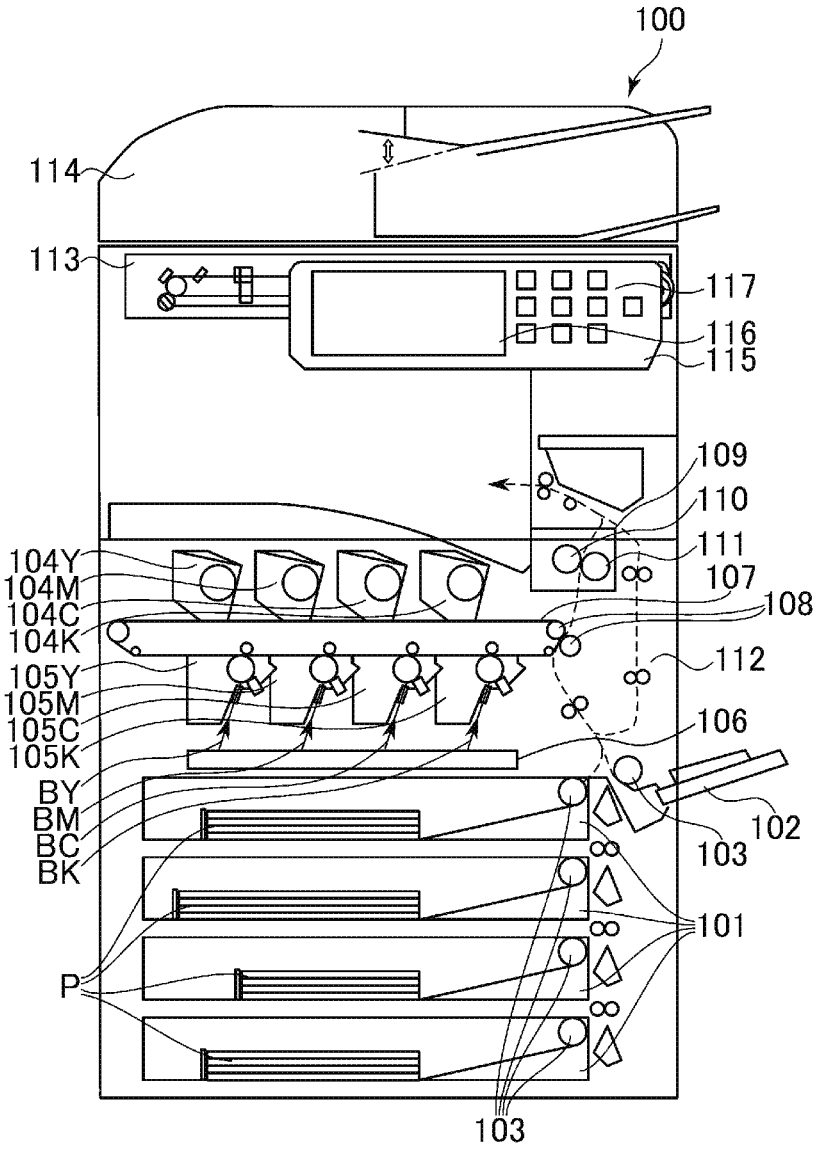
FIG. 1 is a view illustrating an example of an outline of a configuration of an image forming apparatus according to an embodiment.

FIG. 1 is a view illustrating an example of an outline of a configuration of an image forming apparatus 100 according to an embodiment.

The image forming apparatus 100 is, for example, a multifunction peripheral (MFP), a copying machine, a printer, a facsimile, or the like. However, hereinafter, the image forming apparatus 100 will be described as the MFP. The image forming apparatus 100 has, for example, a print function, a scan function, a copy function, a decolorization function, and a facsimile function. The print function is a function of forming an image on an image forming medium P or the like using a recording material such as a toner. The image forming medium P is, for example, a sheet-like paper. The scan function is a function of reading an image from a manuscript or the like on which an image is formed. The copy function is a function of printing an image read from a manuscript or the like using the scan function on the image forming medium P using the print function. The decolorization function is a function of decolorizing an image formed on the image forming medium P with the decolorable recording material. The image forming apparatus 100 includes, for example, a paper feed tray 101, a manual feed tray 102, a paper feed roller 103, a toner cartridge 104, an image forming unit 105, an optical scanning device 106, a transfer belt 107, a secondary transfer roller 108, a fixing unit 109, a heating unit 110, a pressure roller 111, a both-side unit 112, a scanner 113, a manuscript feeding device 114, and an operation panel 115. The paper feed tray 101 accommodates the image forming medium P used for printing.

The manual feed tray 102 is a table for manually feeding the image forming medium P.

The paper feed roller 103 is rotated by the action of a motor to carry out the image forming medium P accommodated in the paper feed tray 101 or the manual feed tray 102 from the paper feed tray 101.

The toner cartridge 104 stores a recording material such as a toner to be supplied to the image forming unit 105. The image forming apparatus 100 includes a plurality toner cartridges 104. As an example, as illustrated in FIG. 1, the image forming apparatus 100 includes the four toner cartridges 104 of a toner cartridge 104C, a toner cartridge 104M, a toner cartridge 104Y, and a toner cartridge 104K. Each of the toner cartridge 104C, the toner cartridge 104M, the toner cartridge 104Y, and the toner cartridge 104K stores a recording material corresponding to each color of cyan, magenta, yellow, and key (black) (CMYK). The color of the recording material stored in the toner cartridge 104 is not limited to each color of CMYK, and may be another color. The recording material stored in the toner cartridge 104 may be a special recording material. For example, the toner cartridge 104 stores a decolorable recording material which is decolorized at a temperature higher than a predetermined temperature and becomes invisible.

Figure 2:
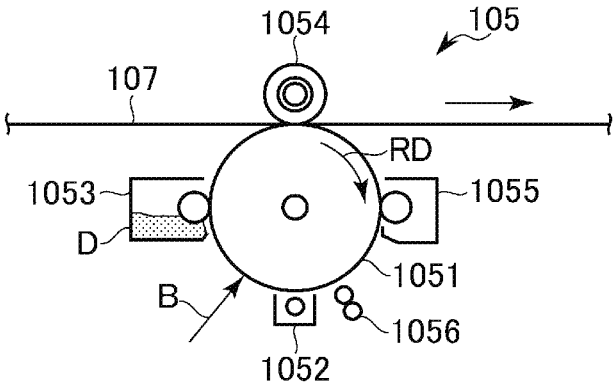
FIG. 2 is a view illustrating an example of an outline of a configuration of an image forming unit of FIG. 1.

The image forming apparatus 100 includes a plurality of the image forming units 105. As an example, as illustrated in FIG. 1, the image forming apparatus 100 includes the four image forming units 105 of an image forming unit 105C, an image forming unit 105M, an image forming unit 105Y, and an image forming unit 105K. Each of the image forming unit 105C, the image forming unit 105M, the image forming unit 105Y, and the image forming unit 105K forms an image with a recording material corresponding to each color of CMYK. The image forming unit 105 will be further described with reference to FIG. 2. FIG. 2 is a schematic view illustrating an example of an outline of a configuration of the image forming unit 105. As an example, the image forming unit 105 includes a photoreceptor drum 1051, a charging unit 1052, a developing unit 1053, a primary transfer roller 1054, a cleaner 1055, and a charge elimination lamp 1056.

The photoreceptor drum 1051 is hit by a beam B emitted from the optical scanning device 106. With this configuration, an electrostatic latent image is formed on a surface of the photoreceptor drum 1051.

The charging unit 1052 charges a predetermined positive charge on the surface of the photoreceptor drum 1051.

The developing unit 1053 develops the electrostatic latent image on the surface of the photoreceptor drum 1051 using a recording material D supplied from the toner cartridge 104. With this configuration, an image of the recording material D is formed on the surface of the photoreceptor drum 1051.

The primary transfer roller 1054 is disposed at a position facing the photoreceptor drum 1051 with the transfer belt 107 interposed therebetween. The primary transfer roller 1054 generates a transfer voltage with the photoreceptor drum 1051. With this configuration, the primary transfer roller 1054 transfers (primarily transfers) the image formed on the surface of the photoreceptor drum 1051 onto the transfer belt 107 in contact with the photoreceptor drum 1051.

The cleaner 1055 removes the recording material D remaining on the surface of the photoreceptor drum 1051.

The charge elimination lamp 1056 eliminates the charge remaining on the surface of the photoreceptor drum 1051.

The optical scanning device 106 is also called a laser scanning unit (LSU). The optical scanning device 106 controls the beam B in accordance with input image data based on control by a processor 121 to form an electrostatic latent image on the surface of the photoreceptor drum 1051 of each image forming unit 105. Here, the input image data is, for example, image data read from a manuscript or the like by the scanner 113. Alternatively, here, the input image data is image data transmitted from another apparatus or the like and received by the image forming apparatus 100.

The beam B emitted by the optical scanning device 106 to the image forming unit 105Y is referred to as a beam BY, the beam B emitted by the optical scanning device 106 to the image forming unit 105M is referred to as a beam BM, and the beam B emitted by the optical scanning device 106 to the image forming unit 105C is referred to as a beam BC, and the beam B emitted by the optical scanning device 106 to the image forming unit 105K is referred to as a beam BK. Accordingly, the optical scanning device 106 controls the beam BY according to a yellow (Y) component of image data. The optical scanning device 106 controls the beam BM according to a magenta (M) component of image data. The optical scanning device 106 controls the beam BC according to a cyan (C) component of the image data. The optical scanning device 106 controls the beam BK according to a key (K) component of the image data. The optical scanning device 106 will be further described hereinafter.

The transfer belt 107 is, for example, an endless belt, and can be rotated by the action of a roller. The transfer belt 107 is rotated to transport the image transferred from each image forming unit 105 to the position of the secondary transfer roller 108.

The secondary transfer roller 108 includes two rollers facing each other. The secondary transfer roller 108 transfers (secondarily transfers) the image formed on the transfer belt 107 onto the image forming medium P passing between the secondary transfer rollers 108.

The fixing unit 109 applies heat and pressure to the image forming medium P on which the image is transferred. With this configuration, the image transferred onto the image forming medium P is fixed. The fixing unit 109 includes the heating unit 110 and the pressure roller 111 facing each other.

The heating unit 110 is, for example, a roller provided with a heat source for heating the heating unit 110. The heat source is, for example, a heater. The roller heated by the heat source heats the image forming medium P.

Alternatively, the heating unit 110 may include an endless belt suspended by a plurality of rollers. For example, the heating unit 110 includes a plate-like heat source, an endless belt, a belt conveyance roller, a tension roller, and a press roller. The endless belt is, for example, a film-like member. The belt conveyance roller drives the endless belt. The tension roller applies tension to the endless belt. The press roller has an elastic layer formed on the surface. The heat generating part side of the plate-like heat source contacts the inner side of the endless belt and is pressed in the direction of the press roller, thereby forming a fixing nip of a predetermined width between the plate-like heat source and the press roller. The plate-like heat source is configured to heat while forming a nip area, and thus responsiveness at the time of energization is higher than that in a heating method by a halogen lamp.

The pressure roller 111 pressurizes the image forming medium P passing between the pressure roller 111 and the heating unit 110.

The both-side unit 112 enables the image forming medium P to be in a state where printing on a back surface is possible. For example, in the both-side unit 112, the front and back of the image forming medium P are reversed by switching back the image forming medium P using a roller or the like.

The scanner 113 is, for example, an optical reduction-type scanner provided with an imaging device such as a charge-coupled device (CCD) image sensor. Alternatively, the scanner 113 is a scanner of contact image sensor (CIS) system including an imaging device, such as a complementary metal-oxide-semiconductor (CMOS) image sensor. Alternatively, the scanner 113 may be a scanner of another known method. The scanner 113 reads an image from a manuscript or the like.

The manuscript feeding device 114 is also called, for example, an auto document feeder (ADF) or the like. The manuscript feeding device 114 conveys the manuscripts placed on a tray for a manuscript one after another. The image of the conveyed manuscript is read by the scanner 113. The manuscript feeding device 114 may include a scanner for reading an image from a back surface of the manuscript. The surface on which the image is read by the scanner 113 is a front surface.

The operation panel 115 includes a man-machine interface and the like for performing input and output between the image forming apparatus 100 and the operator of the image forming apparatus 100. The operation panel 115 includes, for example, a touch panel 116 and an input device 117.

The touch panel 116 is, for example, a panel obtained by stacking a display such as a liquid crystal display or an organic EL display and a pointing device by touch input. The display included in the touch panel 116 functions as a display device for displaying a screen for notifying the operator of the image forming apparatus 100 of various types of information. The touch panel 116 functions as an input device that receives a touch operation by the operator.

Figure 3:
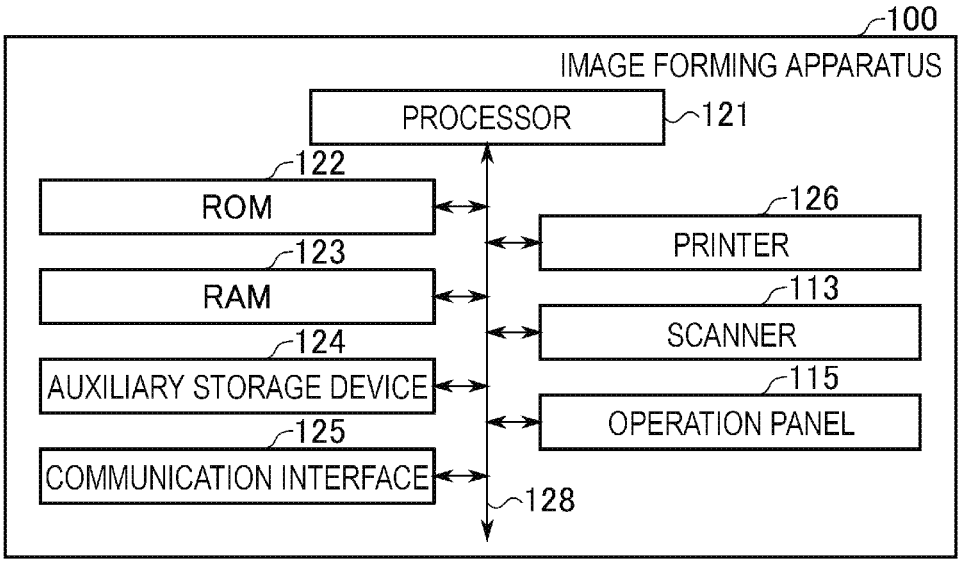
FIG. 3 is a block diagram illustrating an example of a circuit configuration of a main part of the image forming apparatus of FIG. 1.

The input device 117 receives an operation by the operator of the image forming apparatus 100. The input device 117 is, for example, a keyboard, a keypad, or a touch pad. Next, a circuit configuration of a main part of the image forming apparatus 100 will be described with reference to FIG. 3. FIG. 3 is a block diagram illustrating an example of the circuit configuration of the main part of the image forming apparatus 100. As an example, the image forming apparatus 100 includes the processor 121, a read-only memory (ROM) 122, a random-access memory (RAM) 123, an auxiliary storage device 124, a communication interface 125, a printer 126, the scanner 113, and the operation panel 115. Then, a bus 127 and the like connect these units.

The processor 121 corresponds to a central part of a computer that performs processing such as computation and control necessary for the operation of the image forming apparatus 100. The processor 121 controls respective units to realize various functions of the image forming apparatus 100 based on programs such as system software, application software, and firmware stored in the ROM 122, the auxiliary storage device 124, or the like. A part or all of the programs may be incorporated in the circuit of the processor 121. The processor 121 may be, for example, a central processing unit (CPU), a micro processing unit (MPU), a system on a chip (SoC), a digital signal processor (DSP), a graphics processing unit (GPU), an application specific integrated circuit (ASIC), a programmable logic device (PLD), or a field-programmable gate array (FPGA). Alternatively, the processor 121 is a combination of a plurality of these components.

The ROM 122 corresponds to a main storage device of a computer having the processor 121 as a center. The ROM 122 is a non-volatile memory used exclusively for reading data. The ROM 122 stores, for example, firmware among the programs described above. The ROM 122 also stores data used when the processor 121 performs various processing, various setting values, and the like.

The RAM 123 corresponds to a main storage device of a computer having the processor 121 as a center. The RAM 123 is a memory used for reading and writing data. The RAM 123 is used as a so-called work area or the like for storing data temporarily used when the processor 121 performs various processing. The RAM 123 is, for example, a volatile memory.

The auxiliary storage device 124 corresponds to an auxiliary storage device of a computer having the processor 121 as a center. The auxiliary storage device 124 is, for example, an electric erasable programmable read-only memory (EEPROM), a hard disk drive (HDD), a solid state drive (SSD), or an embedded MultiMediaCard (eMMC). The auxiliary storage device 124 stores, for example, system software and application software among the programs described above. The auxiliary storage device 124 stores data used when the processor 121 performs various processing, data generated by processing of the processor 121, various setting values, and the like. The image forming apparatus 100 may include, as the auxiliary storage device 124, an interface into which a storage medium such as a memory card or a universal serial bus (USB) memory can be inserted. The interface reads and writes information on the storage medium.

The communication interface 125 is an interface for the image forming apparatus 100 to communicate via a network or the like.

The printer 126 performs printing on the image forming medium P. The printer 126 includes, for example, the toner cartridge 104, the image forming unit 105, the optical scanning device 106, the transfer belt 107, the secondary transfer roller 108, the fixing unit 109, and the both-side unit 112.

The bus 127 includes a control bus, an address bus, a data bus, and the like, and transmits signals transmitted and received by each unit of the image forming apparatus 100.

Figure 4:
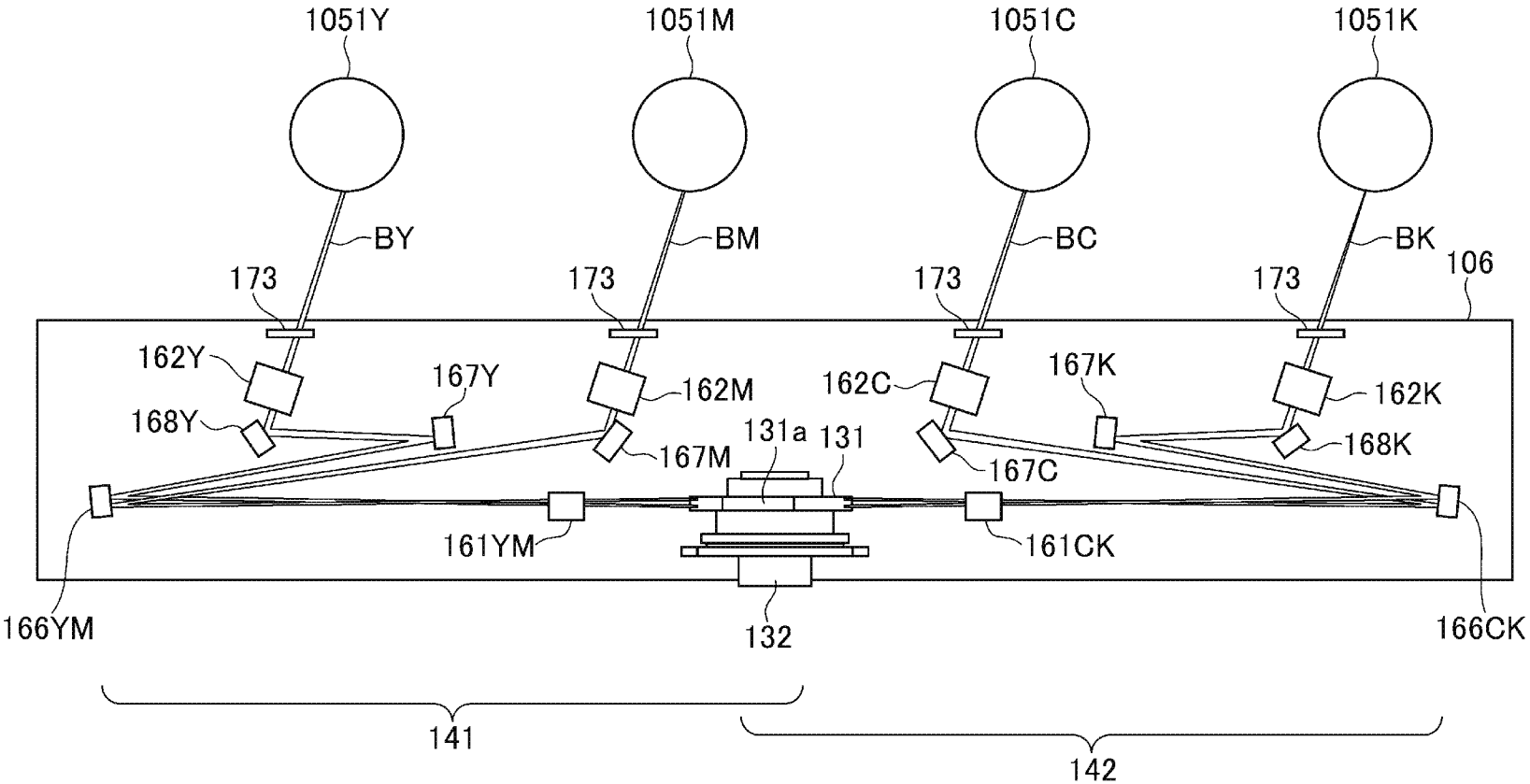
FIG. 4 is a view illustrating an example of an optical scanning device of FIG. 1.
Figure 5:
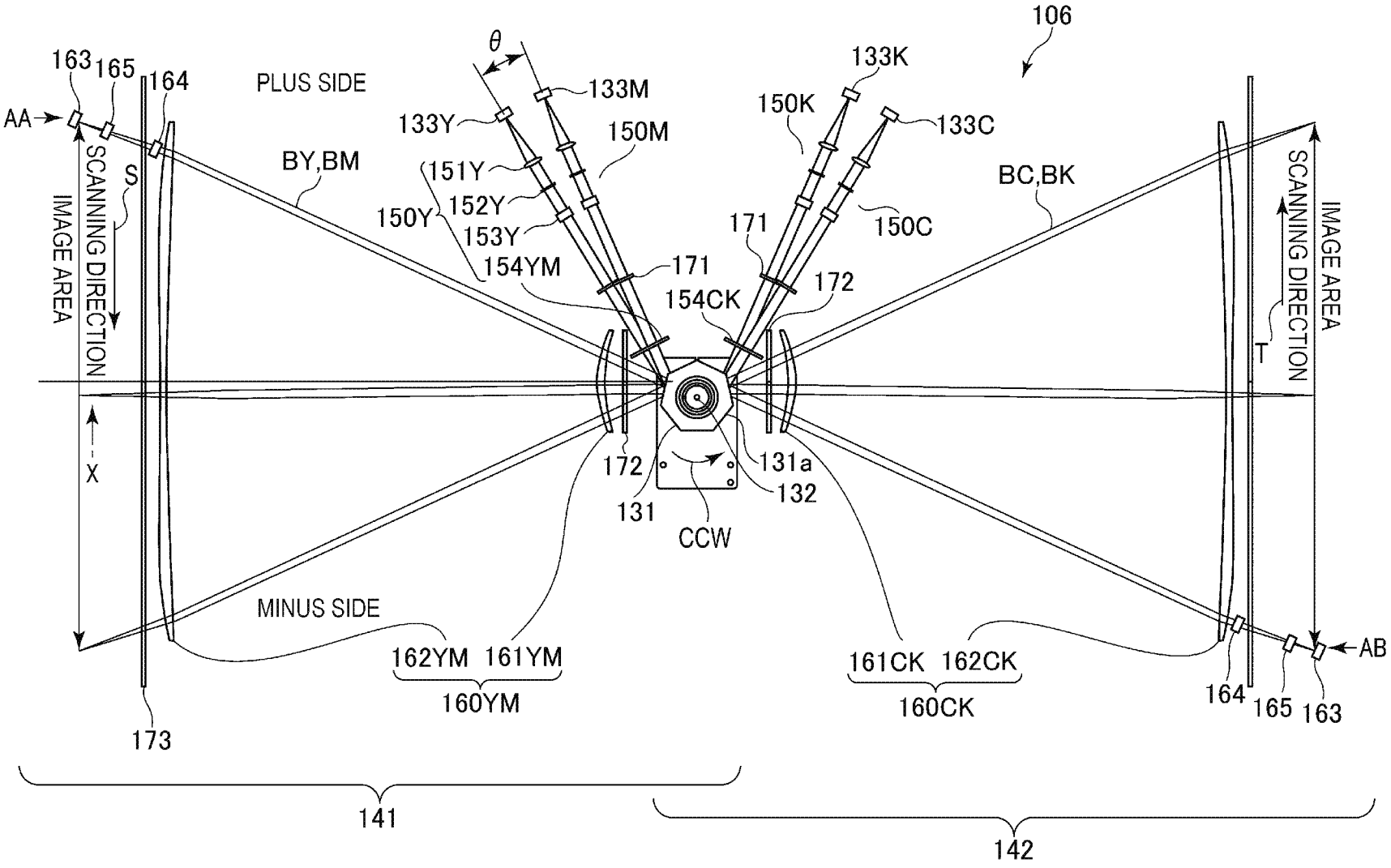
FIG. 5 is a view in which an example of an optical system of the optical scanning device of FIG. 1 is developed on a plane.
Figure 6:
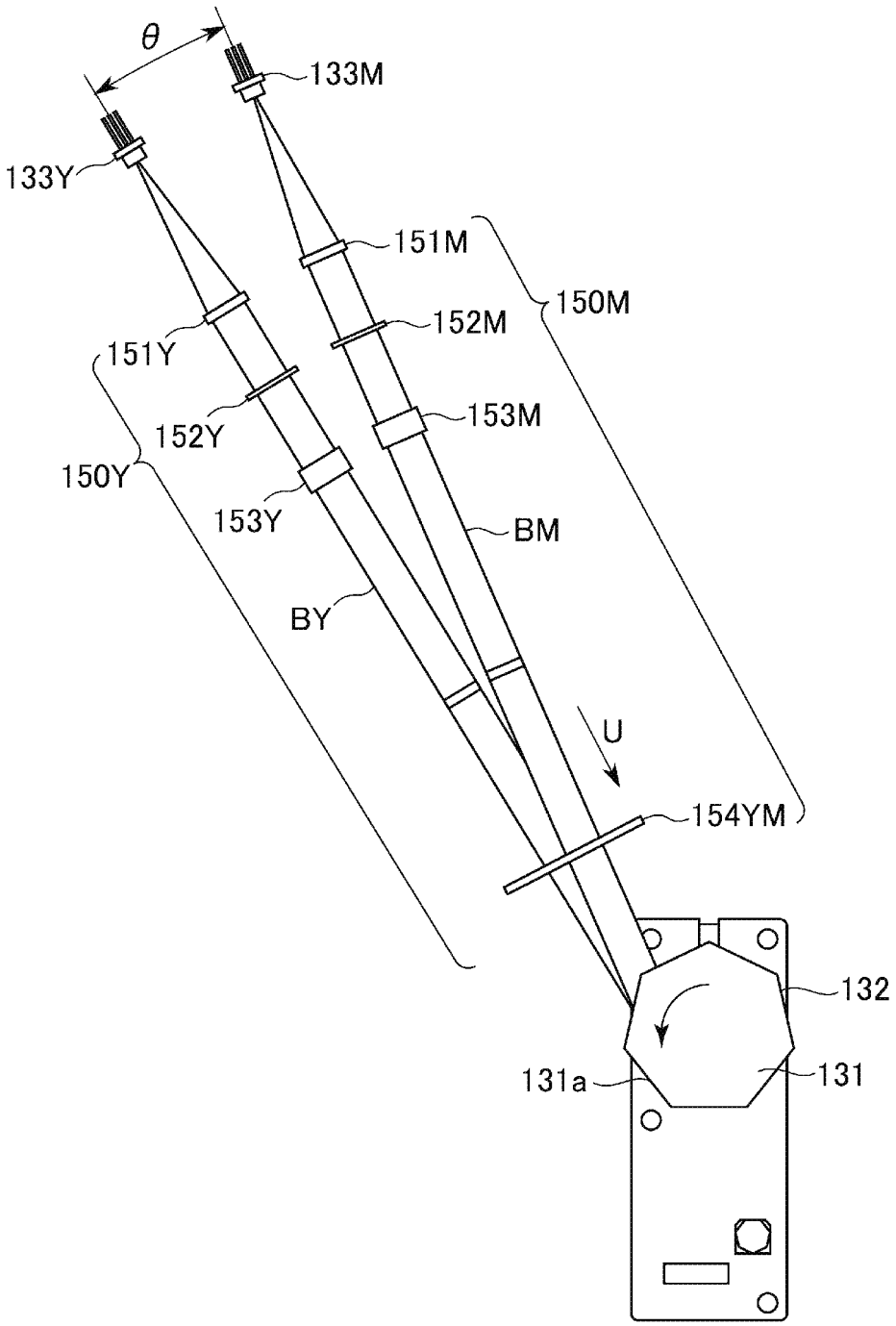
FIG. 6 is a partially enlarged view of the main part of FIG. 5.
Figure 7:
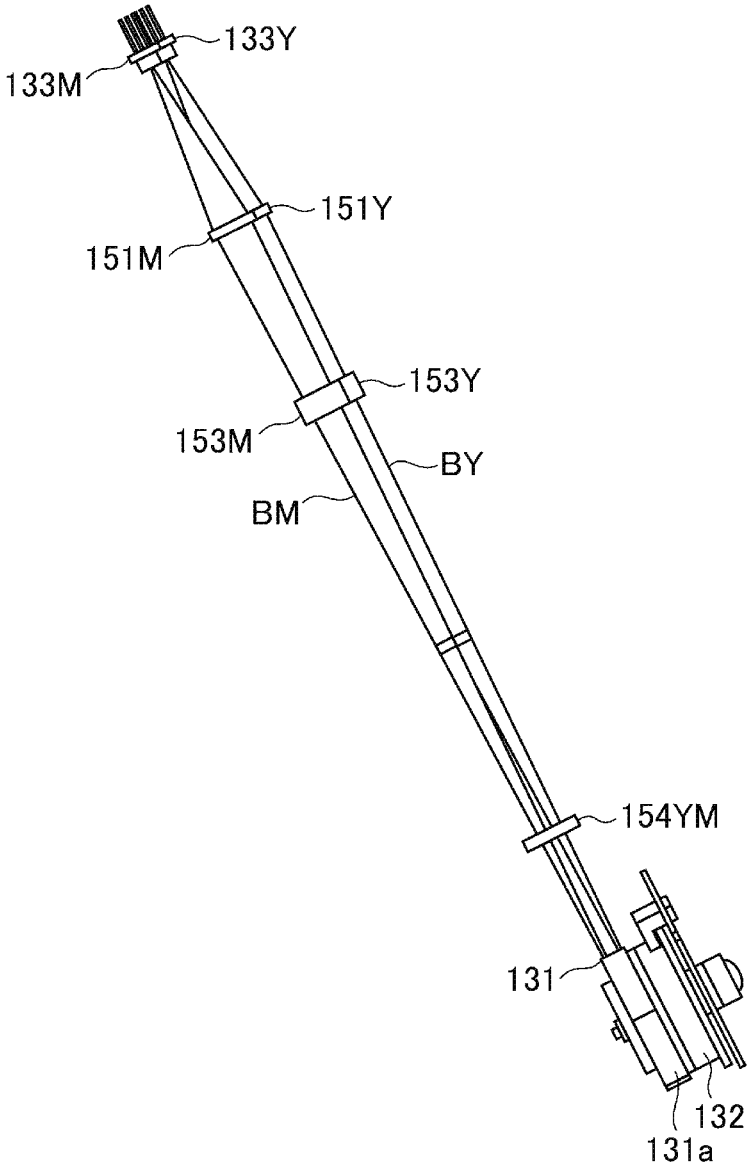
FIG. 7 is a view illustrating a structure of FIG. 6 when viewed from a side.

The optical scanning device 106 will be further described below with reference to FIGS. 4 to 7 and the like. FIG. 4 is a view illustrating an example of the optical scanning device 106. FIG. 5 is a view in which an example of the optical system of the optical scanning device 106 is developed on a plane. FIG. 6 is a partially enlarged view partially enlarging the main part of FIG. 5. FIG. 7 is a view illustrating a structure of FIG. 6 when viewed from the side. The optical scanning device 106 includes, for example, a polygon mirror 131, a motor 132, a light source 133, and a plurality of optical elements.

The polygon mirror 131 is a regular polygonal prismatic mirror (deflector), each side surface of which is a reflection surface 131*a* that reflects a laser. As an example, the polygon mirror 131 illustrated in FIGS. 4 to 7 is a regular heptagonal prismatic mirror provided with the seven reflection surfaces 131*a*. The seven reflection surfaces 131*a* provided in the polygon mirror 131 are continuous along a rotation direction CCW (counterclockwise direction in FIG. 5) of the polygon mirror 131, and constitute an outer circumferential surface of the polygon mirror 131. The polygon mirror 131 is rotatable around a rotation axis parallel to each of the reflection surfaces 131*a*. The rotation axis of the polygon mirror 131 is orthogonal to the rotation axis of each photoreceptor drum 1051. The paper surface of FIG. 6 is a plane perpendicular to the rotation axis of the polygon mirror 131.

The motor 132 rotates the polygon mirror 131 in the rotation direction CCW at a predetermined speed. A rotation axis of the motor 132 and the rotation axis of the polygon mirror 131 are, as an example, coaxial. However, the rotation axis of the motor 132 and the rotation axis of the polygon mirror 131 may not be coaxial.

The light source 133 emits the beam B such as a laser beam. The light source 133 includes, for example, a plurality of laser diodes. That is, the beam B is a multi-beam composed of beams emitted from the plurality of laser diodes. Each of the plurality of laser diodes has a distance in the main scanning direction. Accordingly, each beam included in the beam B also has a distance in the main scanning direction. The optical scanning device 106 includes, as an example, the four light sources 133 of a light source 133C, a light source 133M, a light source 133Y, and a light source 133K. For example, the light source 133Y emits the beam BY corresponding to the Y-component, the light source 133M emits the beam BM corresponding to the M-component, the light source 133C emits the beam BC corresponding to the C-component, and the light source 133K emits the beam BK corresponding to the K-component.

The optical scanning device 106 irradiates the surface of each photoreceptor drum 1051 with each beam B through a light path formed by a predetermined scanning optical system provided for each beam B. The scanning optical system includes a plurality of optical elements. As an example, as illustrated in FIGS. 4 and 5, in the optical scanning device 106, with two beams B as one set, one set of scanning optical systems is disposed on each of the left and right sides with the polygon mirror 131 at the center. That is, as illustrated in FIGS. 4 and 5, the optical scanning device 106 includes two scanning optical systems 141 and 142 that respectively include a plurality of optical elements on both sides (right and left sides in the drawing) of the single polygon mirror 131 serving as the center. The polygon mirror 131 is included in each of the scanning optical system 141 and the scanning optical system 142. That is, the polygon mirrors 131 which are respectively included in the scanning optical system 141 and the scanning optical system 142 are the same polygon mirror 131.

The scanning optical system 141 on the left side in the drawing includes a scanning optical system that performs scan with the beam BY and a scanning optical system that performs scan with the beam BM. The scanning optical system 141 reflects the beam BY emitted from the light source 133Y and the beam BM emitted from the light source 133M on the same reflection surface 131*a* of the polygon mirror 131 which rotates in the rotation direction CCW. With this configuration, the beam BY and the beam BM are deflected in the main scanning direction along the rotation direction CCW, and scan the surfaces of two photoreceptor drums 1051Y and 1051M, respectively. The scanning optical system 141 includes the polygon mirror 131, the light source 133Y, the light source 133M, a pre-deflection optical system 150Y, a pre-deflection optical system 150M, and a post-deflection optical system 160YM.

As an example, one of the beam BY or the beam BM is an example of first light flux, and the other is second light flux. The light source 133Y or the light source 133M which emits the first light flux is a first light source. The light source 133Y or the light source 133M which emits the second light flux is a second light source.

Here, a direction (circumferential direction of the polygon mirror 131) in which each beam B is deflected (scan) by the polygon mirror 131 which is a deflector is defined as a "main scanning direction". A direction orthogonal to the main scanning direction and orthogonal to the optical axis direction of the beam B is defined as a "sub-scanning direction" of the beam B. In FIGS. 5 and 6, the rotation axis direction of the polygon mirror 131 is the sub-scanning direction. In FIGS. 5 and 6, the direction orthogonal to the rotation axis direction of the polygon mirror 131 and orthogonal to the optical axis direction of the beam B is the main scanning direction of the beam B.

The scanning optical system 142 on the right side in the drawing includes a scanning optical system that performs scan with the beam BC and a scanning optical system that performs scan with the beam BK. The scanning optical system 142 reflects the beam BC emitted from the light source 133C and the beam BK emitted from the light source 133K on the same reflection surface 131*a* of the polygon mirror 131 which rotates in the rotation direction CCW. With this configuration, the beam BC and the beam BK are deflected in the main scanning direction along the rotation direction CCW, and scan the surfaces of two photoreceptor drums 1051C and 1051K, respectively. The scanning optical system 142 includes the polygon mirror 131, the light source 133C, the light source 133K, a pre-deflection optical system 150C, pre-deflection optical system 150K, and a post-deflection optical system 160CK.

As an example, one of the beam BC or the beam BK is an example of first light flux, and the other is second light flux. The light source 133C or the light source 133K which emits the first light flux is a first light source. The light source 133C or the light source 133K which emits the second light flux is a second light source.

Here, the polygon mirror 131, the light source 133, and the pre-deflection optical system 150 will be further described by taking the scanning optical system 141 on the left side in the drawing as an example. The polygon mirror 131 rotates while reflecting two beams B of the beam BY emitted from the light source 133Y and the beam BM emitted from the light source 133M on the same reflection surface 131*a*. With this configuration, two image planes respectively disposed at predetermined positions, that is, the surfaces of the corresponding photoreceptor drums 1051Y and 1051M are scanned in the main scanning direction (rotation axis direction of the photoreceptor drum 1051) at a predetermined linear speed. In this case, the image forming apparatus 100 rotates the photoreceptor drum 1051Y and the photoreceptor drum 1051M in the sub-scanning direction. With this configuration, an electrostatic latent image corresponding to the Y-component is formed on the surface of the photoreceptor drum 1051Y. An electrostatic latent image corresponding to the M-component is formed on the surface of the photoreceptor drum 1051M.

As illustrated in FIGS. 5 and 6, the light source 133Y and the light source 133M of the scanning optical system 141 are disposed at different angular positions when viewed from the front side of the paper surface. That is, the two light sources 133Y and 133M are disposed such that the directions in which the beam BY and the beam BM are incident on the reflection surface 131*a* have an opening angle θ. In other words, the two light sources 133Y and 133M are disposed such that the beam BY and the beam BM have the opening angle θ in the main scanning direction. The light source 133Y in the two light sources is located downstream of the light source 133M along the rotation direction CCW of the polygon mirror 131. In contrast, the light source 133M is located upstream of the light source 133Y along the rotation direction CCW.

Also, as illustrated in FIG. 7, the two light sources 133Y and 133M are located at a position slightly separated in the sub-scanning direction. The light source 133M is located at a position higher than the light source 133Y. That is, the light source 133M is located on the front side of the paper surface of FIGS. 5 and 6 with respect to the light source 133Y. The optical axes (light beam traveling direction) of the pre-deflection optical system 150Y and the pre-deflection optical system 150M are orthogonal to a rotation axis 131*b* of the polygon mirror 131. For that reason, the beam BY and the beam BM emitted from the light source 133Y and the light source 133M are incident on the same reflection surface 131*a* at a position slightly separated in the sub-scanning direction.

The scanning optical system 141 includes a pre-deflection optical system 150 on each of the light paths between the light source 133 and the polygon mirror 131. That is, the scanning optical system 141 includes two pre-deflection optical systems 150 of the pre-deflection optical system 150Y and the pre-deflection optical system 150M. The pre-deflection optical system 150Y is disposed on the light path between the light source 133Y and the polygon mirror 131. The pre-deflection optical system 150M is disposed on the light path between the light source 133M and the polygon mirror 131. Each pre-deflection optical system 150 includes a collimator lens 151, a sub-scanning aperture 152, a cylinder lens 153, and a main scanning aperture 154. The pre-deflection optical system 150Y includes a collimator lens 151Y, a sub-scanning aperture 152Y, a cylinder lens 153Y, and a main scanning aperture 154YM. The pre-deflection optical system 150M includes a collimator lens 151M, a sub-scanning aperture 152M, a cylinder lens 153M, and the main scanning aperture 154YM. The collimator lens 151Y and the collimator lens 151M are the collimator lens 151. The sub-scanning aperture 152Y and the sub-scanning aperture 152M are the sub-scanning aperture 152. The cylinder lens 153Y and the cylinder lens 153M are the cylinder lens 153. Furthermore, the main scanning aperture 154YM is the main scanning aperture 154. The main scanning apertures 154YM which are respectively included in the pre-deflection optical system 150Y and the pre-deflection optical system 150M are the same main scanning aperture 154YM.

The collimator lens 151 imparts predetermined convergence to the beam B emitted from the light source 133. The collimator lens 151 collimates the beam B.

The sub-scanning aperture 152 shapes a shape of the beam B passing through the collimator lens 151 in the sub-scanning direction. For example, the sub-scanning aperture 152 shapes a width of the beam B in the sub-scanning direction into a predetermined width. The sub-scanning aperture 152 for shaping the first light flux is an example of the first aperture. The sub-scanning aperture 152 for shaping the second light flux is an example of the second aperture.

The cylinder lens 153 imparts predetermined convergence in the sub-scanning direction to the beam B passing through the sub-scanning aperture 152. With this configuration, the width of the beam B passing through the cylinder lens 153 narrows in the sub-scanning direction as the beam B approaches the reflection surface 131*a*. For that reason, it becomes possible for a plurality of beams B to be incident at a position separated in the sub-scanning direction so as not to overlap the same reflection surface 131*a*.

The main scanning aperture 154 shapes the shape of the beam B passing through the cylinder lens 153 in the main scanning direction. For example, the sub-scanning aperture 152 shapes the width of the beam B in the main scanning direction into a predetermined width. The main scanning aperture 154 will be further described hereinafter. The main scanning aperture 154 is an example of a third aperture.

Furthermore, the polygon mirror 131, the light source 133, and the pre-deflection optical system 150 of the scanning optical system 142 on the right side in the drawing will also be described. The polygon mirror 131 rotates while reflecting the two beams B of the beam BC emitted from the light source 133C and the beam BK emitted from the light source 133K on the same reflection surface 131*a*. With this configuration, two image planes respectively disposed at predetermined positions, that is, the surfaces of the corresponding photoreceptor drums 1051C and 1051K are scanned in the main scanning direction (rotation axis direction of the photoreceptor drum 1051) at a predetermined linear speed. In this case, the image forming apparatus 100 rotates the photoreceptor drum 1051C and the photoreceptor drum 1051K in the sub-scanning direction. With this configuration, an electrostatic latent image corresponding to the C-component is formed on the surface of the photoreceptor drum 1051C.

An electrostatic latent image corresponding to the K-component is formed on the surface of the photoreceptor drum 1051K.

Similar to the light source 133Y and the light source 133M of the scanning optical system 141 described above, the two light sources 133C and 133K of the scanning optical system 142 are disposed at different angular positions when viewed from the front side of the paper surface of FIGS. 5 and 6. That is, the two light sources 133C and 133K are disposed such that the directions in which the beam BC and the beam BK are incident on the reflection surface 131*a* have the opening angle θ. In other words, the two light sources 133C and 133K are disposed such that the beam BC and the beam BK have the opening angle θ in the main scanning direction. The light source 133C in the two light sources is located upstream of the light source 133K along the rotation direction CCW of the polygon mirror 131. In contrast, the light source 133K is located downstream of the light source 133C along the rotation direction CCW.

The light source 133C and the light source 133K are located at a position slightly separated in the sub-scanning direction. The light source 133C is located at a position higher than the light source 133K. For that reason, the beam BC and the beam BK emitted from the light source 133C and the light source 133K are incident on the same reflection surface 131*a* at a position slightly separated in the sub-scanning direction.

The scanning optical system 142 includes the pre-deflection optical system 150 on each of the light paths between the light source 133 and the polygon mirror 131. That is, the scanning optical system 142 includes the two pre-deflection optical systems 150 of the pre-deflection optical system 150C and the pre-deflection optical system 150K. The pre-deflection optical system 150C is disposed on the light path between the light source 133C and the polygon mirror 131. The pre-deflection optical system 150K is disposed on the light path between the light source 133K and the polygon mirror 131. The pre-deflection optical system 150C includes a collimator lens 151C, a sub-scanning aperture 152C, a cylinder lens 153C, and a main scanning aperture 154CK. The pre-deflection optical system 150K includes a collimator lens 151K, a sub-scanning aperture 152K, a cylinder lens 153K, and the main scanning aperture 154CK. The collimator lens 151C and the collimator lens 151K are the collimator lens 151. The sub-scanning aperture 152C and the sub-scanning aperture 152K are the sub-scanning aperture 152. The cylinder lens 153C and the cylinder lens 153K are the cylinder lens 153. Furthermore, the main scanning aperture 154CK is the main scanning aperture 154. The main scanning apertures 154CK which are respectively included in the pre-deflection optical system 150C and the pre-deflection optical system 150K are the same main scanning aperture 154CK. As described above, the scanning optical system 142 includes the same components as those of the scanning optical system 141.

Next, the post-deflection optical system 160 will be described. The post-deflection optical system 160 guides the beam B reflected by the reflection surface 131*a* to the surface of the photoreceptor drum 1051. The optical scanning device 106 includes two post-deflection optical systems 160 of a post-deflection optical system 160YM and a post-deflection optical system 160CK. The post-deflection optical system 160 includes an fθ lens 161, an fθ lens 162, a light detector 163, a folding mirror 164, a light path correction element 165, and folding mirrors 166 to 168.

The fθ lens 161 and the fθ lens 162 are a set of two image forming lenses that optimize the shape and position of the beam B deflected (scanned) by the polygon mirror 131 on an image plane.

One upstream fθ lens 161 close to the polygon mirror 131 is provided for one post-deflection optical system 160. That is, the fθ lens 161 is located on the light path of one set of two beams B. Then, one set of two beams B pass through the same fθ lens 161. For example, an fθ lens 161YM is located on the light path of the beam BY and the light path of the beam BM. Then, the beam BY and the beam BM pass through the fθ lens 161YM. In FIG. 5, one downstream fθ lens 162 close to the photoreceptor drum 1051 is illustrated for each post-deflection optical system 160. However, as illustrated in FIG. 6, one fθ lens 162 is provided independently in the light path of each beam B. An fθ lens 162YM illustrated in FIG. 5 collectively indicates an fθ lens 162Y and an fθ lens 162M illustrated in FIG. 6. An fθ lens 162CK illustrated in FIG. 5 collectively indicates an fθ lens 162C and an fθ lens 162K illustrated in FIG. 6. The fθ lens 162Y, the fθ lens 162M, the fθ lens 162C, and the fθ lens 162K are the fθ lenses 162. Each beam B passes through each fθ lens 162 on each light path. The fθ lenses 162 are respectively positioned in the vicinity of a third cover glass 173 described hereinafter.

The light detectors 163 are respectively located at end portions (scan position AA and scan position AB) of a scan start portion of the beam B. The light detectors 163 are respectively provided to match horizontal synchronization of the beams B passing through the fθ lens 161 and the fθ lens 162.

The folding mirrors 164 are respectively located on the light path directed from the fθ lens 162 to the light detector 163. The folding mirrors 164 respectively reflect the beam B to fold the beam B back to the light detector 163. However, in FIG. 5, the light paths of the beam B and the light detectors 163, the folding mirrors 164, and the light path correction elements 165 on the light path are illustrated by being developed on a plane.

The light path correction elements 165 are respectively located on the light path between the folding mirrors 164 and the light detectors 163. The light path correction elements 165 respectively guide the beams B reflected by the folding mirrors 164 onto a detection surface of the light detectors 163.

The folding mirrors 166 to 168 are a plurality of mirrors that fold the beam B, which passes through the fθ lens 161, back toward the surface of each photoreceptor drum 1051 by reflecting the beam B. The optical scanning device 106 includes the two folding mirrors 166 of a folding mirror 166YM and a folding mirror 166CK. The optical scanning device 106 includes the four folding mirrors 167 of a folding mirror 167Y, a folding mirror 167M, a folding mirror 167C, and a folding mirror 167K. The optical scanning device 106 includes the two folding mirrors 168 of a folding mirror 168Y and a folding mirror 168K. In FIG. 5, the folding mirrors 166 to 168 are not illustrated.

Further, the optical scanning device 106 includes a first cover glass 171, a second cover glass 172, and a third cover glass 173.

The first cover glass 171 is located between the pre-deflection optical system 150 and the polygon mirror 131. The second cover glass 172 is between the polygon mirror 131 and the post-deflection optical system 160. The first cover glass 171 and the second cover glass 172 are provided to prevent wind noise when the polygon mirror 131 rotates. The first cover glass 171 prevents the wind noise from leaking from the entrance of the beam B. The second cover glass 172 prevents the wind noise from leaking from the exit of the beam B. The third cover glass 173 is located between the fθ lens 162 and the photoreceptor drum 1051. The third cover glass 173 covers the exit from which the beam B is emitted in a casing of the optical scanning device 106.

As described above, in the optical scanning device 106, the scanning optical system 141 and the scanning optical system 142 are disposed on the left and right side with the polygon mirror 131 at the center. For that reason, when the optical scanning device 106 rotates the polygon mirror 131 in a certain direction, the scanning direction of the photoreceptor drum 1051 by the scanning optical system 141 and the scanning direction of the photoreceptor drum 1051 by the scanning optical system 142 are reversed. Here, in FIG. 5, it is assumed that a side (upper side on the paper surface) on which the light source 133Y, the light source 133M, the light source 133C, and the light source 133K are drawn with the polygon mirror 131 at the center is a plus side and the opposite side (lower side on the paper surface) is the minus side. In this case, the scanning optical system 141 scans the image plane in a direction from the plus side to the minus side indicated by an arrow S. In contrast, the scanning optical system 142 scans the image plane in a direction from the minus side to the plus side indicated by an arrow T.

The main scanning aperture 154 will be further described using FIG. 8 to FIG. 11.

Figure 8:
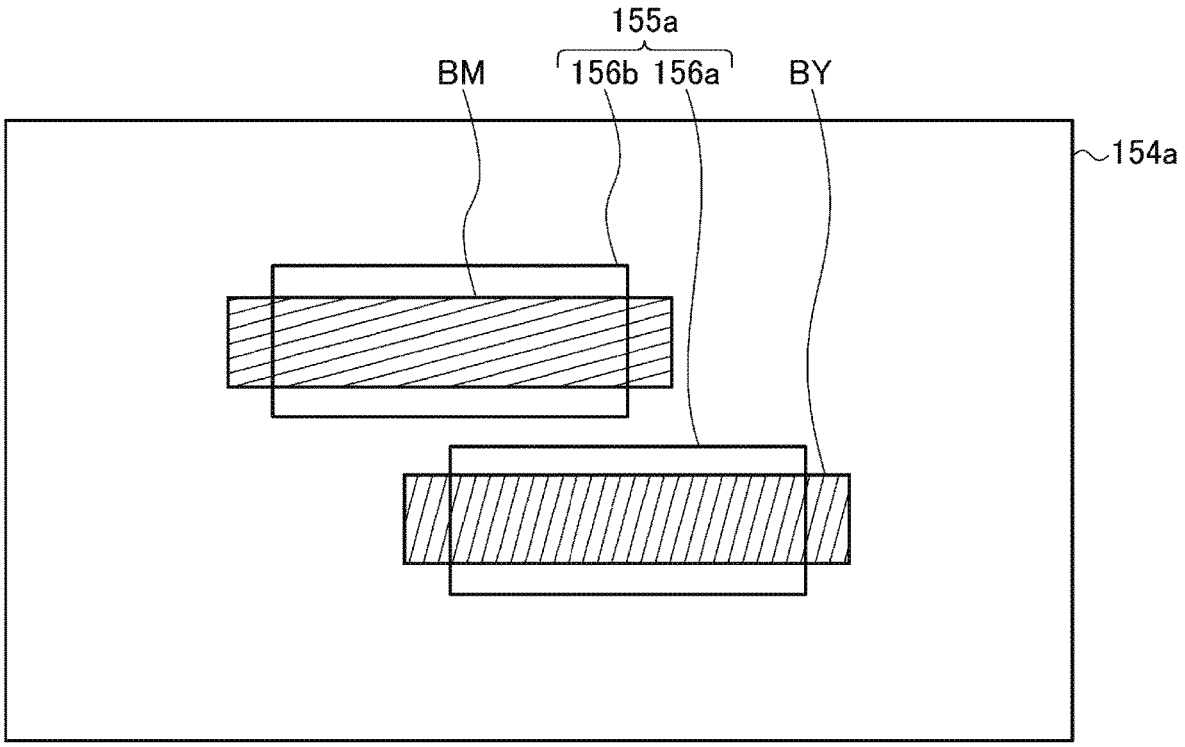
FIG. 8 is a view illustrating an example of a main scanning aperture of FIG. 5.
Figure 9:
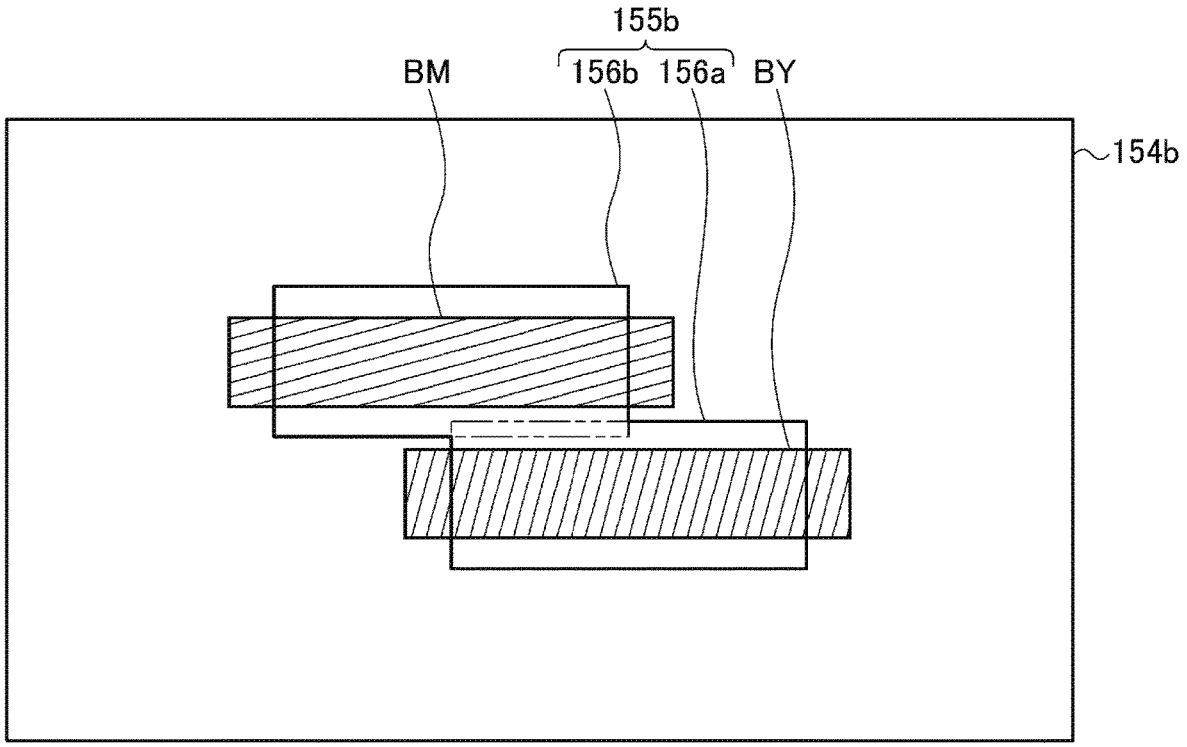
FIG. 9 is a view illustrating another example of the main scanning aperture of FIG. 5.

FIGS. 8 and 9 illustrate a main scanning aperture 154*a* and a main scanning aperture 154*b* as an example of the main scanning aperture 154. FIG. 8 and FIG. 9 are views illustrating an example of the main scanning aperture 154, respectively. The main scanning aperture 154 illustrated in FIGS. 8 and 9 is the main scanning aperture 154YM. The main scanning aperture 154 illustrated in FIGS. 8 and 9 is a plan view of the main scanning aperture 154 when viewed from the side on which the light source 133 is located. The main scanning aperture 154 illustrated in FIGS. 8 and 9 is a plan view of the main scanning aperture 154 when viewed from the direction of an arrow U.

The main scanning aperture 154 is a plate-like member. The main scanning aperture 154 has an opening 155. A main scanning aperture 154*a* illustrated in FIG. 8 has an opening 155*a* as an example of the opening 155. A main scanning aperture 154*b* illustrated in FIG. 9 has an opening 155*b* as an example of the opening 155. The opening 155 includes two openings 156 of an opening 156*a* and an opening 156*b*. The shape of each opening 156 is a rectangle whose width in the sub-scanning direction is larger than the width of the beam B in the sub-scanning direction. The width of the opening 156 in the sub-scanning direction is such a width that light is not shielded on the sub-scanning direction side (upper side or lower side on the paper surface) of the beam B even if a passing position of the beam B is separated in the sub-scanning direction due to component accuracy and the like.

In the opening 155*a* illustrated in FIG. 8, the opening 156*a* and the opening 156*b* do not overlap each other. Accordingly, an opening 155*c* is composed of the two unconnected openings 156.

In the opening 155*b* illustrated in FIG. 9, the opening 156*a* and the opening 156*b* overlap each other. That is, an opening 155*d* is one opening having a shape in which the two openings 156 are connected.

Figure 10:
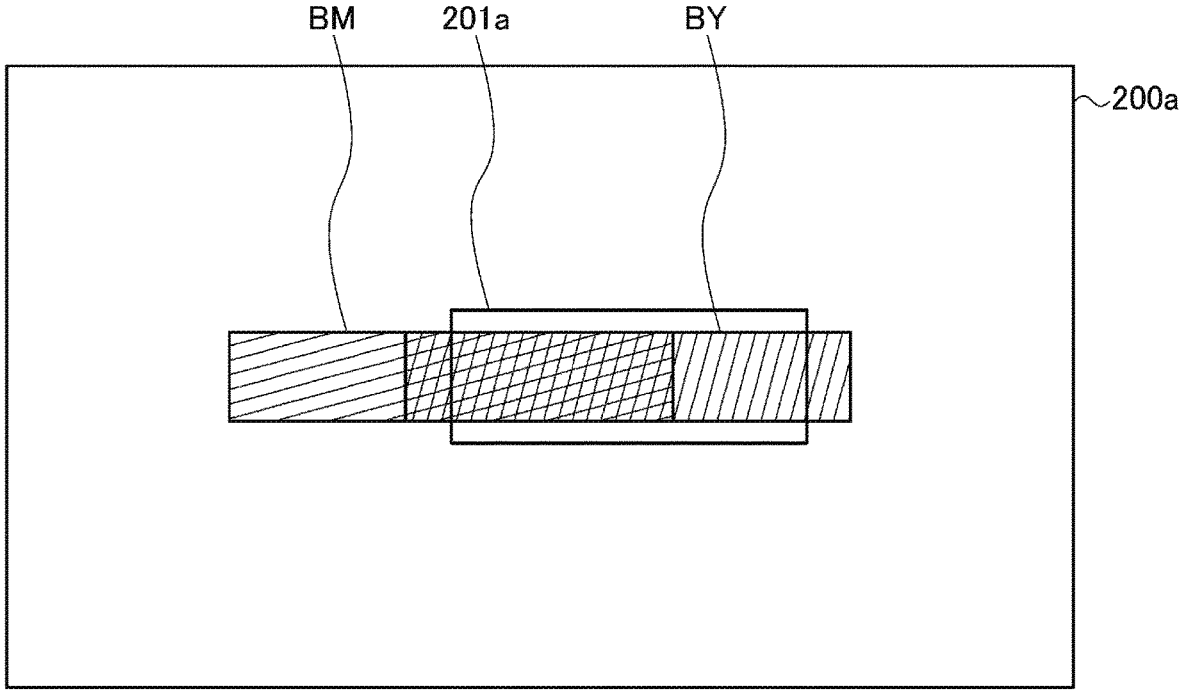
FIG. 10 is a view illustrating a comparative example of the main scanning aperture.
Figure 11:
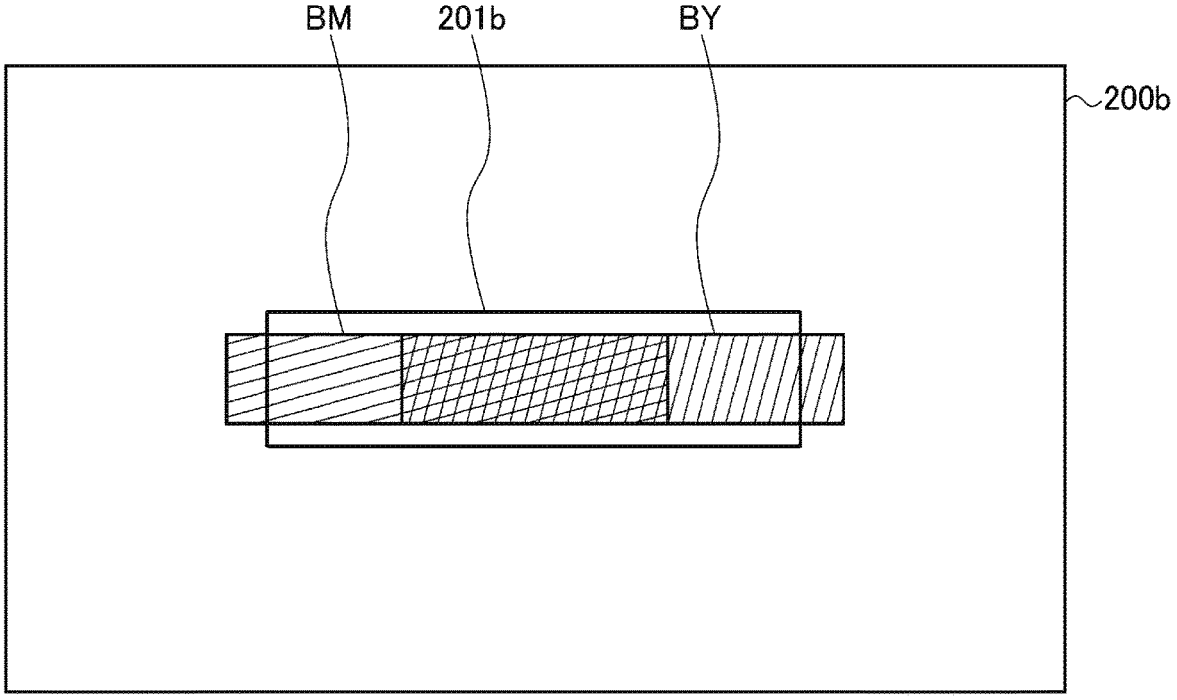
FIG. 11 is a view illustrating another comparative example of the main scanning aperture.

FIGS. 10 and 11 illustrate a main scanning aperture 200*a* and a main scanning aperture 200*b* as comparison targets of the main scanning aperture 154, respectively. FIGS. 10 and 11 are views illustrating comparative examples of the main scanning aperture, respectively. The beams BM and BY illustrated in FIGS. 10 and 11 are not separated in the sub-scanning direction.

The main scanning aperture 200*a* of FIG. 10 has an opening 201*a*. As illustrated in FIG. 10, the main scanning aperture 200*a* can shape a shape of the beam BY in the main scanning direction. However, the main scanning aperture 200*a* unintentionally shields the beam BM, and the shape of the beam BM in the main scanning direction cannot be shaped into a desired shape.

The main scanning aperture 200*b* of FIG. 11 has an opening 201*b*. As illustrated in FIG. 11, the main scanning aperture 200*b* can shape a shape of one side (right side of the drawing) of the beam BY in the main scanning direction, but cannot shape a shape of the other side (left side of the drawing) of the beam BY in the main scanning direction. The main scanning aperture 200*b* can shape a shape of one side (left side of FIG. 11) of the beam BM in the main scanning direction, but cannot shape a shape of the other side (right side of FIG. 11) of the beam BM in the main scanning direction.

As described above, when the beam BM and the beam BY are not separated in the sub-scanning direction or when the beam BM and the beam BY are separated only slightly in the sub-scanning direction, the main scanning aperture cannot shape the shapes of both the beam BM and the beam BY in the main scanning direction into desired shapes.

In contrast, in the optical scanning device 106 of the embodiment, the beam BM and the beam BY are separated in the sub-scanning direction. However, the positions of the beam BM and the beam BY in the main scanning direction overlap each other. The beam B is condensed in the sub-scanning direction by passing through the cylinder lens 153. For that reason, the optical scanning device 106 can prevent the beam BM and the beam BY from overlapping in the sub-scanning direction until reaching the main scanning aperture 154. As illustrated in FIG. 8, when the beam BM and the beam BY are sufficiently separated in the sub-scanning direction, the opening 156*a* and the opening 156*b* can be individually disposed so as not to overlap each other. In contrast, as illustrated in FIG. 9, when the distance between the beam BM and the beam BY separated in the sub-scanning direction is small, the opening 156*a* and the opening 156*b* overlap each other. As the beam BM and the beam BY are further apart in the sub-scanning direction, the width of the polygon mirror 131 in the sub-scanning direction needs to be larger. The smaller the width of the polygon mirror 131 in the sub-scanning direction, the smaller the optical scanning device 106 can be. Further, as the width of the polygon mirror 131 in the sub-scanning direction is smaller, the time taken to stably rotate at a specified rotational speed from the start of rotation can be shortened. Furthermore, as the width of the polygon mirror 131 in the sub-scanning direction is smaller, the time taken to stop rotation of the polygon mirror 131 can be shortened. Accordingly, it is better for the distance between the beam BM and the beam BY separated in the sub-scanning direction to be short.

Locating the main scanning aperture 154 closer to the polygon mirror 131 is preferable. As described above, the beam B is a multi-beam composed of a plurality of beams. Each beam included in the beam B has a distance in the main scanning direction. For that reason, each beam included in the beam B passing through the main scanning aperture 154 is likely to spread in the main scanning direction as the distance from the main scanning aperture 154 increases. When each beam included in the beam B spreads in the main scanning direction, it becomes easy for each beam to pass through a position separated from a desired light path. As each beam is separated from the desired light path, vignetting is likely to occur when each beam is reflected by the polygon mirror 131 or a focusing position of each beam is likely to become different, which causes deterioration in image quality. Accordingly, as the main scanning aperture 154 is closer to the polygon mirror 131, a curvature of field is reduced, and thus image quality of the image forming apparatus 100 is improved. For that reason, as in the embodiment, image quality of the image forming apparatus 100 is improved by the main scanning aperture 154 being positioned such that the beam B passes through the main scanning aperture 154 hereinafter than the cylinder lens 153. However, as the main scanning aperture 154 is closer to the polygon mirror 131, the positions of the beam BY and the beam BM in the main scanning direction overlap each other. For that reason, it becomes difficult to dispose an aperture individually for each beam B as in the sub-scanning aperture 152. As in the embodiment, by allowing two beams B of the beam BY and the beam BM to pass through one main scanning aperture 154, it is possible to shape the shape in the main scanning direction near the polygon mirror 131. In the optical scanning device of the related art, an aperture for shaping the shapes in both the main scanning direction and the sub-scanning direction is disposed at the same position as the sub-scanning aperture 152. Further, the main scanning aperture 154*a* and the main scanning aperture 154*b* have a shape in which the opening 155 is opened in one integrated plate-like member. Accordingly, cost can be further reduced than when using two main scanning apertures.

Although the main scanning aperture 154 is described above using the main scanning aperture 154YM, the main scanning aperture 154CK is also the same as the main scanning aperture 154YM. The main scanning aperture 154CK shapes the shapes of the beam BC and beam BK in the main scanning direction.

The embodiment described above can be modified as follows.

In the embodiment described above, the aperture 154 has a shape in which the opening 155 is opened in an integrated member. However, the aperture 154 may be divided into two or more members.

Figure 12:
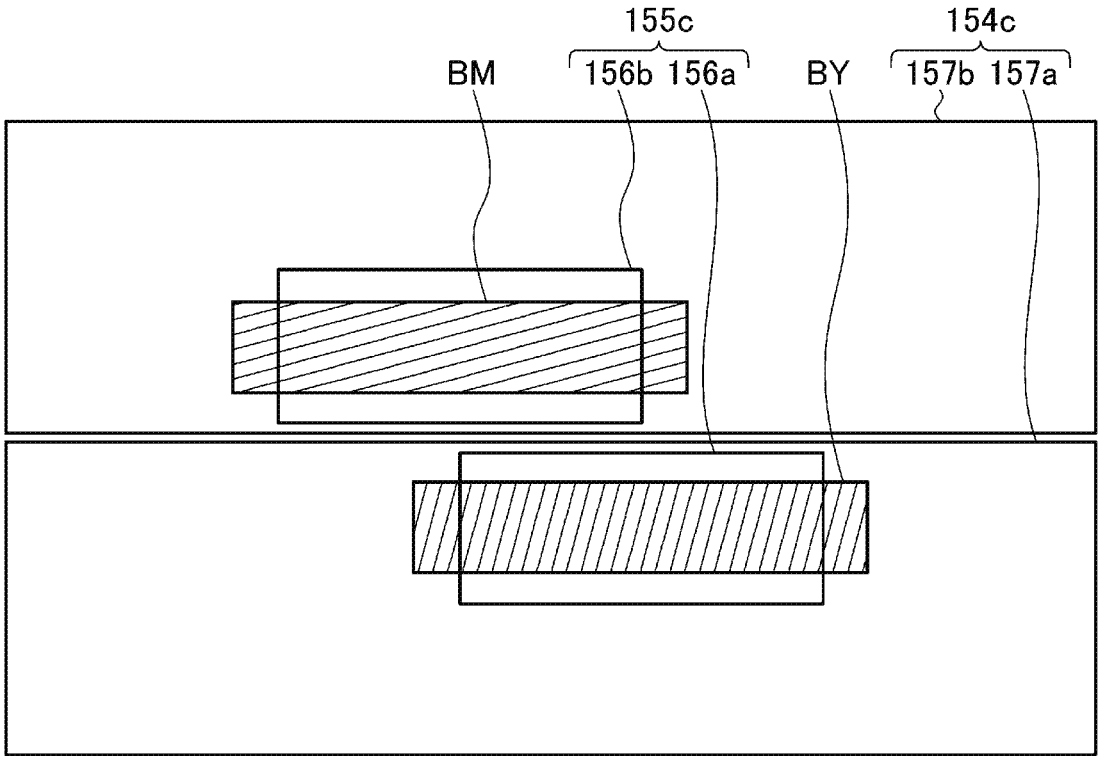
FIG. 12 is a view illustrating another example of the main scanning aperture of FIG. 5.

FIG. 12 illustrates an aperture 154*c* as an example of the aperture 154 divided into two or more members. FIG. 12 is a view illustrating an example of the main scanning aperture 154. The aperture 154*c* has an opening 155*c* as an example of the opening 155. In the opening 155*c*, the opening 156*a* and the opening 156*b* do not overlap each other. Accordingly, the opening 155*c* is composed of the two unconnected openings 156. The aperture 154*c* is divided into two members in the sub-scanning direction. That is, the aperture 154*c* is composed of two members of a member 157*a* having the opening 156*a* and a member 157*b* having the opening 156*b*.

Figure 13:
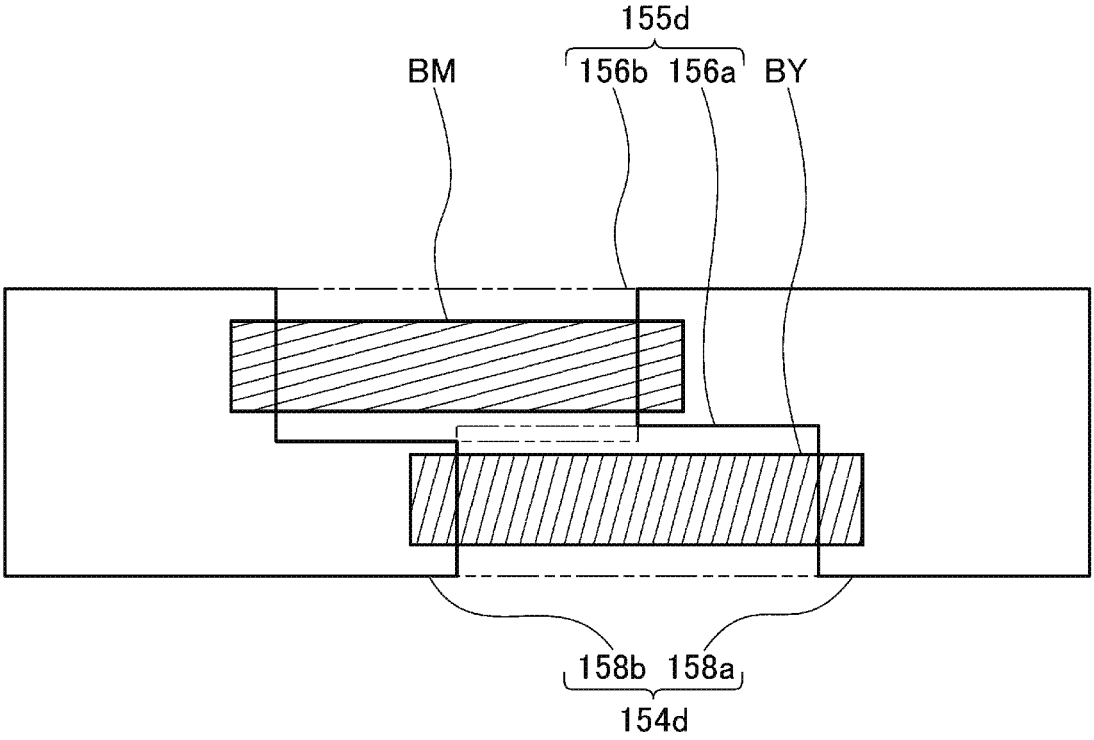
FIG. 13 is a view illustrating another example of the main scanning aperture of FIG. 5.

FIG. 13 illustrates an aperture 154*d* as an example of the aperture 154 divided into two or more members. FIG. 13 is a view illustrating an example of the main scanning aperture 154. The aperture 154*d* has the opening 155*d* as an example of the opening 155. In the opening 155*d*, the opening 156*a* and the opening 156*b* overlap each other. That is, the opening 155*d* is one opening having a shape in which the two openings 156 are connected. The aperture 154*d* is divided into two members in the main scanning direction. That is, the aperture 154*d* is divided into two members by the opening 155*d* because the width of the aperture 154*d* in the sub-scanning direction is equal to or less than the width of the opening in the sub-scanning direction. Further, the opening 155*d* is opened without a member of which portion shields light in the sub-scanning direction.

In the embodiment described above, the shape of the opening 156 is a rectangle. However, the shape of the opening 156 may be a shape other than a rectangle.

Figure 14:
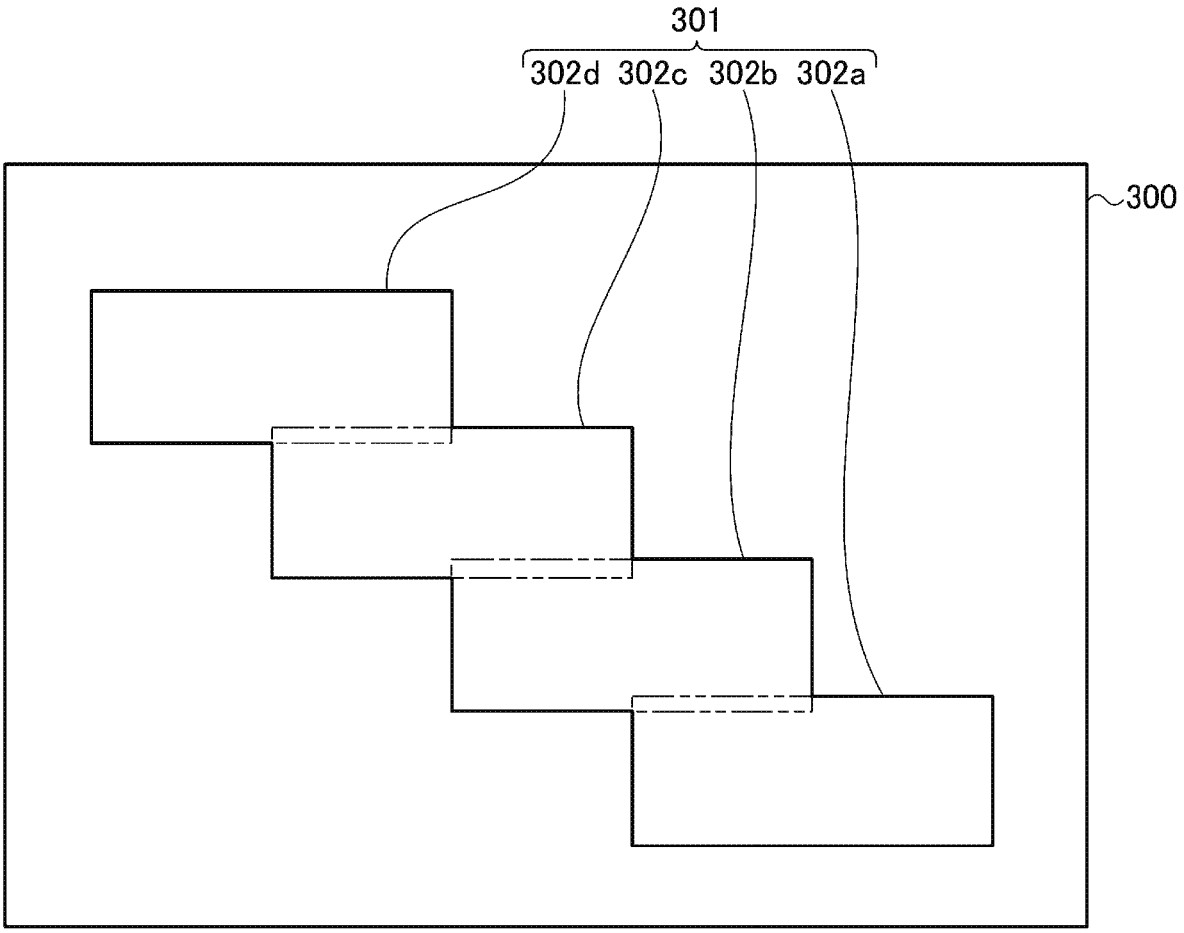
FIG. 14 is a view illustrating a modification example of the main scanning aperture.

In the embodiment described above, the optical scanning device 106 has a disposition in which the photoreceptor drums 1051 and the light sources 133 of respective colors are divided into two groups in the left and right sides with the polygon mirror 131 interposed therebetween. However, in the optical scanning device according to the embodiment, three or more photoreceptor drums 1051 and light sources 133 may be disposed on one side of the polygon mirror 131. In this case, three or more beams B are reflected on the same reflection surface 131*a*. FIG. 14 illustrates an example of the shape of the main scanning aperture when four beams B are reflected on the same reflection surface. A main scanning aperture 300 illustrated in FIG. 14 includes an opening 301. The opening 301 is one opening having a shape in which the four openings 301 of openings 302*a* to 302*d* are connected. The shape of each opening 301 is a rectangle whose width in the sub-scanning direction is larger than the width of the beam B in the sub-scanning direction. The opening 302*a* and the opening 302*b* are connected to each other by partially overlapping each other. The opening 302*b* and the opening 302*c* are connected to each other by partially overlapping each other. The opening 302*c* and the opening 302*d* are connected to each other by partially overlapping each other. However, a combination of at least one of the opening 302*a* or the opening 302*b*, the opening 302*b* and the opening 302*c*, and the opening 302*c* and the opening 302*d* may not overlap. In this case, the opening 301 is an opening composed of a plurality of unconnected openings. The beam B passes through each of the openings 302*a* to 302*d*. With this configuration, the openings 302*a* to 302*d* shape the shape of the beam B passing through the openings 302*a* to 302*d* in the main scanning direction.

In the embodiment described above, the image forming apparatus 100 uses four types of recording materials respectively corresponding to four colors of CMYK. However, the image forming apparatus according to the embodiment may use two, three, or five or more types of recording materials. In this case, the image forming apparatus according to the embodiment includes, for example, the same number of the photoreceptor drums 1051 and the light sources 133 as the number of types of recording materials.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An optical scanning device comprising:

a first light source configured to emit a first light flux, the first light flux having a first beam shape;

a second light source configured to emit a second light flux, the second light flux having a second beam shape and an opening angle with respect to the first light flux, the opening angle being defined in a main scanning direction;

a first aperture configured to shape the first beam shape in a sub-scanning direction;

a second aperture configured to shape the second beam shape in the sub-scanning direction;

a third aperture configured to shape the first beam shape in the main scanning direction after the first beam shape has been shaped in the sub-scanning direction by the first aperture, and shape the second beam shape in the main scanning direction after the second beam shape has been shaped in the sub-scanning direction by the second aperture;

a deflector configured to deflect the first light flux at a first position on a surface and deflect the second light flux at a second position on the surface; and a collimator lens disposed between the first light source and the first aperture such that the first light flux passes through the collimator lens prior to passing through the first aperture;

wherein the first position and the second position are separated in the sub-scanning direction.

2. The optical scanning device of claim 1, wherein:

the third aperture comprises a first opening aligned with the first light flux and a second opening aligned with the second light flux;

the first light flux extends through the first opening;

the second light flux extends through the second opening; and the first opening and the second opening are connected.

3. The optical scanning device of claim 1, wherein the third aperture is one integrated member.

4. The optical scanning device of claim 1, wherein:

the first light flux passes through the third aperture at a first location on the third aperture;

the second light flux passes through the third aperture at a second location on the third aperture; and the first location and the second location overlap.

5. The optical scanning device of claim 1, further comprising a cylinder lens disposed between the second aperture and the third aperture such that the second light flux passes through the cylinder lens after passing through the second aperture and before passing through the third aperture.

6. The optical scanning device of claim 1, wherein the deflector is a polygon mirror comprising a plurality of reflection surfaces.

7. The optical scanning device of claim 6, further comprising a motor configured to rotate the polygon mirror between a first position where the first light flux and the second light flux reflect off of one of the plurality of reflection surfaces and a second position where the first light flux and the second light flux reflect off of another of the plurality of reflection surfaces.

8. The optical scanning device of claim 1, wherein:

the first light source is defined by a first color; and the second light source is defined by a second color.

9. An image forming apparatus comprising:

a first light source configured to emit a first light flux, the first light flux having a first beam shape;

a second light source configured to emit a second light flux, the second light flux having a second beam shape and an opening angle with respect to the first light flux, the opening angle being defined in a main scanning direction;

a first aperture configured to shape the first beam shape in a sub-scanning direction;

a second aperture configured to shape the second beam shape in the sub-scanning direction;

a third aperture configured to shape the first beam shape in the main scanning direction after the first beam shape has been shaped in the sub-scanning direction by the first aperture, and shape the second beam shape in the main scanning direction after the second beam shape has been shaped in the sub-scanning direction by the second aperture;

a deflector configured to deflect the first light flux at a first position on a surface and deflect the second light flux at a second position on the surface;

an image forming unit configured to transfer an electrostatic latent image formed by the first light flux and the second light flux deflected by the deflector, as an image, to a medium; and a collimator lens disposed between the first light source and the first aperture such that the first light flux passes through the collimator lens prior to passing through the first aperture.

10. The image forming apparatus of claim 9, wherein:

the third aperture comprises a first opening aligned with the first light flux and a second opening aligned with the second light flux;

the first light flux extends through the first opening;

the second light flux extends through the second opening; and the first opening and the second opening are connected.

11. The image forming apparatus of claim 9, wherein:

the first light flux passes through the third aperture at a first location on the third aperture;

the second light flux passes through the third aperture at a second location on the third aperture; and the first location and the second location overlap.

12. The image forming apparatus of claim 9, further comprising a cylinder lens disposed between the second aperture and the third aperture such that the second light flux passes through the cylinder lens after passing through the second aperture and before passing through the third aperture.

13. The image forming apparatus of claim 9, wherein the deflector is a polygon mirror comprising a plurality of reflection surfaces.

14. The image forming apparatus of claim 13, further comprising a motor configured to rotate the polygon mirror between a first position where the first light flux and the second light flux reflect off of one of the plurality of reflection surfaces and a second position where the first light flux and the second light flux reflect off of another of the plurality of reflection surfaces.

15. The image forming apparatus of claim 9, wherein:

the first light source is defined by a first color; and the second light source is defined by a second color.

16. A device comprising:

a first light source configured to emit a first light beam with a first beam shape;

a second light source configured to emit a second light beam with a second beam shape;

a first aperture aligned with the first light source and configured to receive the first light beam, alter the first beam shape in a sub-scanning direction, and provide the first light beam;

a second aperture aligned with the second light source and configured to receive the second light beam, alter the second beam shape in the sub-scanning direction, and provide the second light beam;

a third aperture aligned with the first light source and the second light source, configured to receive the first light beam from the first aperture, receive the second light beam from the second aperture, alter the first beam shape in a main scanning direction, and alter the second beam shape in the main scanning direction;

a deflector configured to deflect the first light beam at a first position on a surface and deflect the second light beam at a second position on the surface; and a collimator lens disposed between the first light source and the first aperture such that the first light beam passes through the collimator lens prior to passing through the first aperture;

wherein the first position and the second position are separated in the sub-scanning direction; and wherein the first light source and the second light source are positioned such that the first light beam and the second light beam are separated by an opening angle in the main scanning direction.

17. The device of claim 16, wherein:

the first light beam passes through the third aperture at a first location on the third aperture;

the second light beam passes through the third aperture at a second location on the third aperture; and the first location and the second location overlap.

18. The device of claim 16, further comprising a cylinder lens disposed between the second aperture and the third aperture such that the second light beam passes through the cylinder lens after passing through the second aperture and before passing through the third aperture.

* * * * *